US005543900A

United States Patent [19]

Maebashi et al.

[11] Patent Number: 5,543,900

[45] Date of Patent: Aug. 6, 1996

[54] IMAGE FORMING APPARATUS WHICH REDUCES TONER FUSION ON AN IMAGE BEARING MEMBER

[75] Inventors: Youichirou Maebashi; Haruo Fujii; Hiroshi Sasame; Hiroaki Kawakami, all of Yokohama; Tatsuya Kobayashi, Sohka; Tetsuya Kobayashi, Kawasaki; Naoki Enomoto, Yokohama; Akihiko Uchiyama, Yokohama; Yoshiro Saito, Yokohama, all of Japan

[73] Assignee: Canon Kabushiki Kaisha, Tokyo, Japan

[21] Appl. No.: 357,602

[22] Filed: Dec. 12, 1994

[30] Foreign Application Priority Data

Dec. 10, 1993 [JP] Japan ..... 5-341346
Dec. 5, 1994 [JP] Japan ..... 6-300958

[51] Int. Cl.[6] ..... G03G 15/02

[52] U.S. Cl. ..... 355/219; 361/225

[58] Field of Search ..... 355/219, 245; 361/220, 221, 225

[56] References Cited

U.S. PATENT DOCUMENTS 4,620,783 11/1986 Tanaka et al. ..... 355/206
4,851,960 7/1989 Nakamura et al. ..... 361/225
5,359,395 10/1994 Shimura et al. ..... 355/219
5,426,488 6/1995 Hayakawa et al. ..... 355/219

FOREIGN PATENT DOCUMENTS 50-093437 7/1975 Japan .
63-149668 6/1988 Japan .
63-149669 6/1988 Japan .

*Primary Examiner*—William J. Royer
*Attorney, Agent, or Firm*—Fitzpatrick, Cella, Harper & Scinto

[57] ABSTRACT

An image forming apparatus includes an image bearing member for bearing an image of toner and a charging member contactable to the image bearing member to charge the image bearing member. The charging member is adapted to receive a voltage and the toner has a melt index of not less than 0.5 g/10 min. In the apparatus, $$P/(V \times L) \leqq 50 J/m^2$$

where v is a movement speed of the image bearing member when the image bearing member is charged by the charging member (m/sec), L is an effective charging length of the charging member, measured in a direction perpendicular to the movement direction of the image bearing member (m), and P is an amount of electric power consumed by the charging member (W).

10 Claims, 6 Drawing Sheets

IMAGE FORMING APPARATUS WHICH REDUCES TONER FUSION ON AN IMAGE BEARING MEMBER

FIELD OF THE INVENTION AND RELATED ART

The present invention relates to an image forming apparatus such as a copying machine or printer comprising an image bearing member such as a photosensitive member or a dielectric member and a charging member contactable to said image bearing member to charge the image bearing member.

A color image forming apparatus is known in which in order to form a full-color image, a plurality of colors of toner images are transferred from the photosensitive member as the image bearing member onto a transfer material in an overlaying relationship, and thereafter, the plurality of toner images are fused in mixture on the transfer material by a heat fusing device.

As yellow, magenta, cyan and black toner materials contained in developing devices for forming toner images on the photosensitive member, which have low melting points, are used to enhance the color reproducibility.

Recently, the image forming apparatus such as a laser beam printer is required to provide high image quality, for example, 600 dpi (dot per inch) or 800 dpi, for example, On the other hand, it is also known that a charging roller is contacted to an image bearing member as a primary charging device for uniformly charging the photosensitive member. When the use is made with the primary charging device of contact type, such as a charging roller, in an image forming apparatus using low melting point toner, the toner fusing such as filming or the like on the photosensitive member tends to occur with the result of improper charging or non-uniform charging. As a result, the resultant image has longitudinal stripes. The non-uniformity is particularly conspicuous in a multi-level image provided by PWM or another image processing. In the PWM image processing, a pulse width of a pulse signal supplied to the laser scanner is modulated. This defect imposes difficulty on the image quality enhancement, in addition, the service life of the photosensitive drum is shortened. The toner fusing on the photosensitive member particularly occurs when the charging roller is supplied with an oscillating voltage.

The description will be made as to the toner melting point and the fusing property. In the following description, melt index (MI) is used as a unit for expressing the melting point of the toner, MI means a flowing speed of thermoplastic resin material pushed out through an orifice having a predetermined diameter and a predetermined length, under predetermined temperature and pressure. Therefore, a toner material exhibiting low melting point has a large MI value. The MI value is determined through A method in JIS K-7210, in which the quantity of the material pushed out through the orifice in 10 min. under 125° C. and 320 g. In conventional monochromatic image forming apparatuses, usually, conventional monochromatic image forming apparatuses used MI of 0.1 (g/12 min. or lower, and conventional color image forming apparatuses use approx. 3 (g/10 min).

Table 1 shows results of experiments in which full-color images are formed on 3000 transfer materials intermittently under 30° C., 80% humidity (high temperature and high humidity condition), and the toner fusing on the photosensitive drum is observed.

TABLE 1

| MI value (g/10 min.) | 0.1 | 0.3 | 0.4 | 0.5 | 1.0 | 2.0 | 3.0 |
|---|---|---|---|---|---|---|---|
| Fusing prevention | G | G | G | NG | NG | NG | NG |

The toner fusing on the photosensitive drum has been observed through microscope, and in the Table, "G" means that the toner is not fused on the photosensitive drum. In addition, using the photosensitive drum exhibiting "G", halftone images are formed through PWM (multi-level), and the resultant images are observed, and it has been confirmed that there is no image non-uniformity due to the toner fusing. In the Table, "NG" means that the toner fusing occurs on the photosensitive drum. As a result, the toner fusing occurs very much when the toner has the MI value not less than 0.5 (g/10 min.).

In these tests, the moving speed of the photosensitive drum was 100 (mm/sec), and the charging roller of the primary charging device is supplied with a DC voltage of −700 V biased with an AC voltage of 2600 Vpp (peak-to-peak voltage) and a frequency of 1300 Hz. The bias is equivalent to that in a monochromatic image forming apparatus having the same process speed and having a charging device equivalent to the above-described color forming apparatus. As described hereinbefore, yellow, magenta, cyan and black toner images are sequentially and overlayingly transferred onto a transfer material carried on the photosensitive drum so that an image is formed on a transfer material.

The problem arising from the low toner melting point is not limited to a color image forming apparatus, but arises in all of image forming apparatus using low melting point toner and contact type primary charger.

SUMMARY OF THE INVENTION

Accordingly, it is a principal object of the present invention to provide an image forming apparatus in which toner fusing on an image bearing member is effectively prevented.

It is another object of the present invention to provide an image forming apparatus wherein a heat quantity produced by a charging member is reduced.

It is a further object of the present invention to provide an image forming apparatus in which an image reproducibility is increased when a low melting point toner is used.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
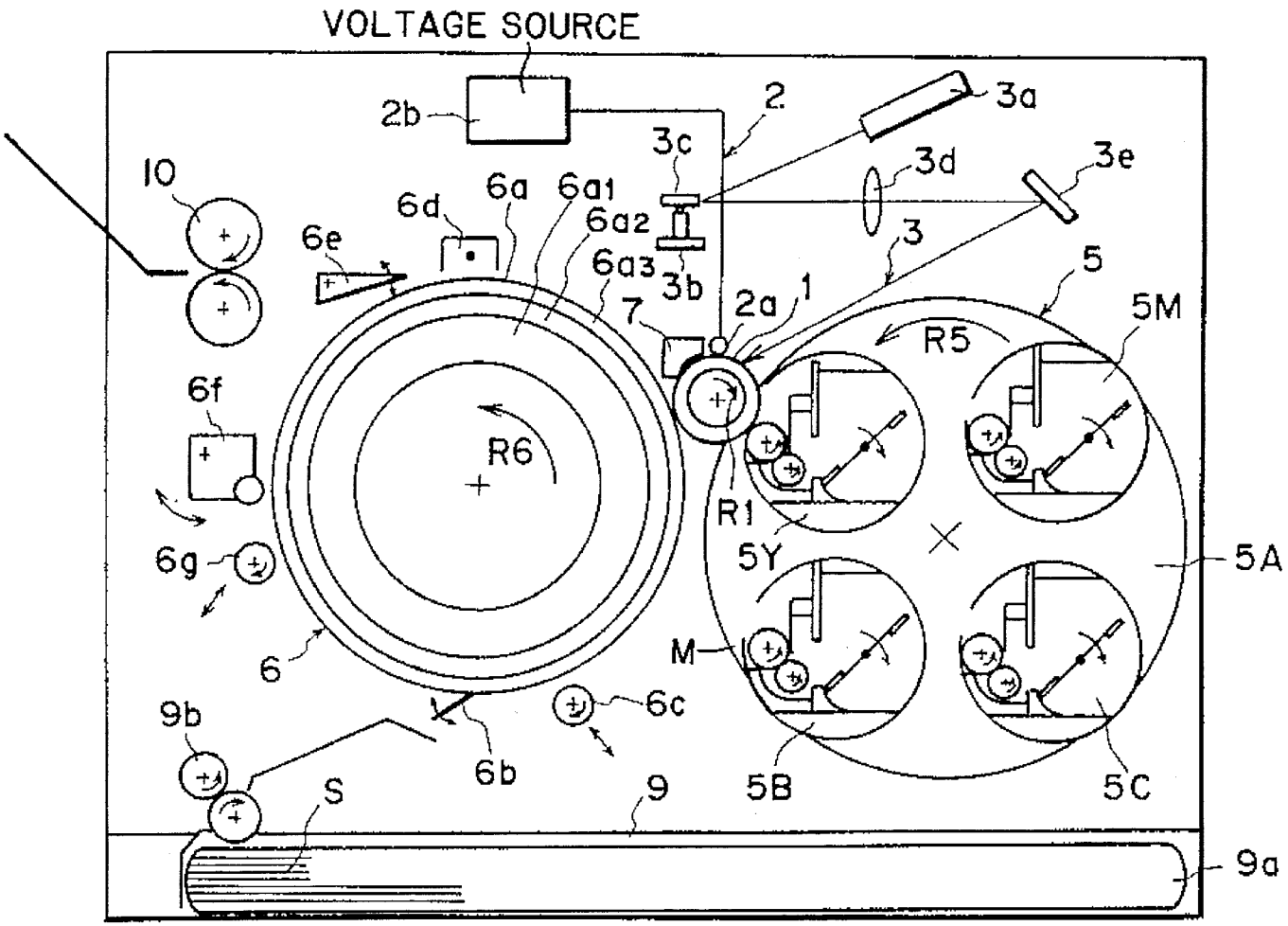
FIG. 1 is a longitudinal sectional view of an image forming apparatus according to an embodiment of the present invention.

Referring now to FIG. 1, there is shown an image forming apparatus according to an embodiment of the present invention.

Substantially at the center of the main assembly M of the apparatus, there is disposed a photosensitive drum 1 which functions as an image bearing member. The photosensitive drum 1 is rotatably supported. Around the photosensitive drum 1, there are provided a primary charger 2, an exposure device 3, a developing device 5, a transfer device 6, a cleaning device 7 and so on in the order named along a rotational movement direction of the photosensitive drum 1 (R1). Below the main assembly M, there is disposed a sheet feeding mechanism 9 for feeding transfer materials S on which the images are formed. Above the main assembly M at the left hand side, an image fixing apparatus 10 is disposed.

Figure 2:
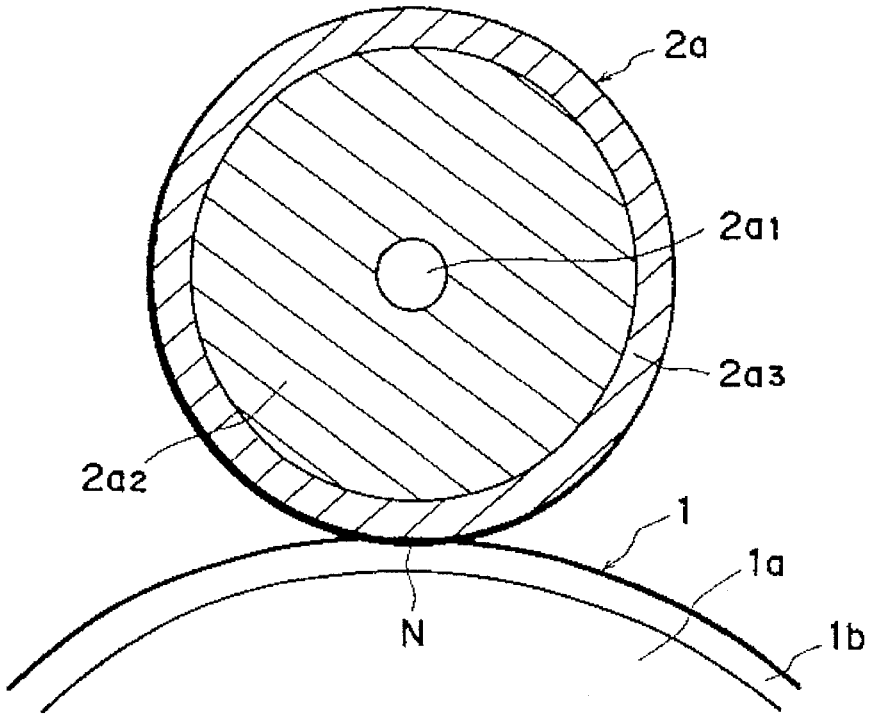
FIG. 2 is a longitudinal sectional view of a charging roller used in Embodiment 1.

As show in FIG. 2 (enlarged sectional view), the photosensitive drum 1 comprises an aluminum cylinder 1*a* having a diameter of 40 mm (electrically grounded), an electrophotoconductive layer 1*b* thereon, which is of organic photoconductor. In place of the organic photoconductor, A-Si (amorphous silicon) CdS, Se or the like are usable. The photosensitive drum 1 is rotatably supported and is rotated by an unshown driving means in a direction R1 at a peripheral speed of 100 mm/sec.

Figure 3:
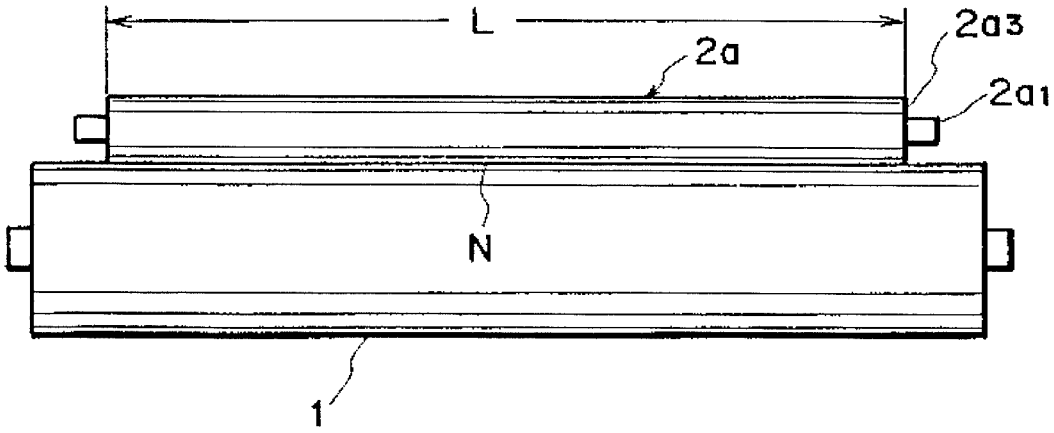
FIG. 3 is a front view of the charging roller used in Embodiment 1.

The charging device 2 comprises a charging roller 2*a* as a charging member of contact type and voltage source 2*b*. The charging roller 2*a* is coated with an elastic layer 2*a*2 of electrically conductive material and a metal core 2*a*1 of electrically conductive material therein. The elastic layer 2*a*2 is further coated with an urethane rubber layer 2*a*3 in which carbon is dispersed. As shown in FIG. 3 (front view), the charging roller 2*a* is contacted to the surface of the photosensitive drum with a proper pressure to form a charging nip N between the photosensitive drum 1 and itself. An effective charging length L (meter) of the charging roller 2*a* at the charging nip N has the same length as the outermost urethane rubber layer of the charging roller 2*a*. To the charging roller 2*a*, a DC voltage of −700 V biased with an AC voltage of 2600 V (Vpp) and a frequency of 1300 Hz. By doing so, the charging roller 2*a* uniformly charges to approx. −700 V the surface of the photosensitive drum at the neighborhood of the charging nip N. Such a charging device 2 is disclosed in Japanese Laid-Open Patent Applications Nos. 149668/1988 and 149669/1988, for example. The power consumption of the charging roller 2*a* will be described hereinafter.

As shown in FIG. 1, the exposure device 3 comprises a laser diode 3*a*, a rotatable polygonal mirror 3*c* driven by a high speed motor 3*b*, a lens 3*d* and a folding mirror 3*e*. When an yellow image is to be formed for example, a signal in accordance with the yellow image pattern is supplied to the laser diode 3*a*. Then, the beam corresponding to the yellow image is emitted from the laser diode 3*a*, and the beam is projected onto the surface of the photosensitive drum 1 having been uniformly charged, through a rotatable polygonal mirror 3*c*, the lens 3*d* and folding mirror 3*e* and so on. The portion of the photosensitive drum 1 exposed to the beam reduces in the potential from −700 V to −100 V, so that an electrostatic latent image corresponding to the yellow image is formed.

Figure 4:
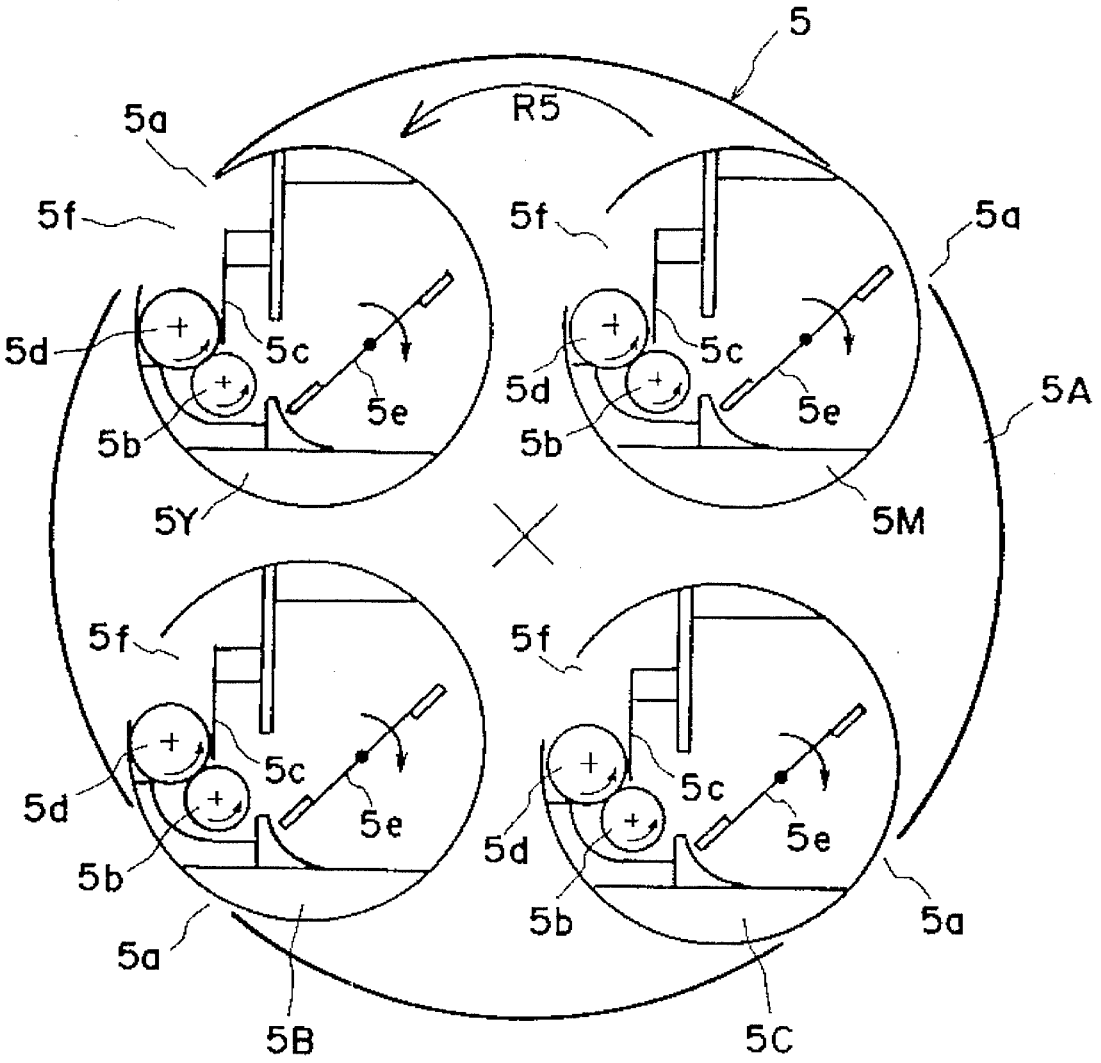
FIG. 4 is an enlarged longitudinal sectional view of a developing apparatus used in Embodiment 1.

The electrostatic latent image on the photosensitive drum 1 is visualized by the image developing device 5. The developing device comprises four developing units carried on a turret 5A rotatably supported on the main assembly of the apparatus, i.e., yellow, magenta, cyan and black developing units 5Y, 5M, 5C and 5B. Each of the toner materials have MI value of approx. 3 g/10 min. The turret 5A is provided with developing openings 5*a* at four positions which divide the outer periphery thereof into equal four portions. As shown in FIG. 4 (enlarged view), each of the developing devices 5Y, 5M, 5C and 5B is provided with an application roller 5*b*, toner regulating member 5*c*, a developing roller 5*d* and stirring member 5*e*. With the rotation of the developing roller 5*d*, the toner is applied on the developing roller 5*d* by the toner application roller 5*b*, and in addition, required triboelectric charge is given to the toner by the toner regulating member 5*c*. The developers contained in the four developing devices do not contain carrier particles, and therefore, the toners are non-magnetic one component developers.

When the toner is to be charged to the negative polarity, the material of the regulating member 5*c* is preferably nylon or the like. When the toner is to be charged to the positive polarity, silicone rubber or the like is preferable. In other words, the material is preferably charged to the polarity opposite from that of the toner. The peripheral speed of the developing roller 5*d* is preferably 1.02–2.0 times the peripheral speed of the photosensitive drum 1. Each of the developing devices 5Y, 5M, 5C and 5B on the turret 5A can be carried to the developing position (the position of the yellow developing device 5Y in FIG. 4) by the rotation of the turret 5A in a direction R5. In this position, the opening 5*f* is aligned with the developing opening 5*a*, so that the developing device is faced to the surface of the photosensitive drum 1. By the yellow developing device 5Y disposed at the developing position by the rotation of the turret 5A, the electrostatic latent image on the photosensitive drum 1 received the yellow toner so that a yellow toner image is formed. As the driving means for the developing device 5Y, the one disclosed in Japanese Laid-Open Patent Application No. 93437/1975 is usable.

The transfer device 6 is provided with a transfer drum 6*a* rotated in a direction R6. The transfer drum 6*a* comprises a metal cylinder 6*a*1 having a diameter of 160 mm, an elastic layer 6*a*2 having a thickness of 2 mm, and an upper layer 6*a*3 wrapped thereon having a thickness of 100 μm (dielectric sheet of PVDF (polyvinylidene fluoride)). The elastic layer 6*a*2 is of foamed urethane material available from INOAC, Japan. A transfer material S supplied by a pick-up roller 9*b* from a sheet feeding cassette 9*a* is held by a gripper 6*b*, and then, is electrostatically attracted onto the surface of the transfer drum 6*a* by an attraction roller 6*c* supplied with a voltage. The yellow toner image formed on the photosensitive drum 1 is transferred onto a transfer material on the transfer drum 6*a* by a voltage applied to the transfer drum 6*a* from an unshown voltage source.

As described above, the process steps from the charging to the transfer carried out for the yellow toner image, are carried out for the other three colors, namely, magenta, cyan and black. As a result, the four color toner images are overlaid on the transfer material S carried on the transfer drum 6a.

The transfer material S supplied with the four color toner images is removed from the transfer drum 6a by a separation charger 6d and a separation claws 6e. The separated transfer material S is fed to an image fixing apparatus 10, where the toner images are heated and pressed so that it is fused and fixed on the surface of the transfer material S into a permanent image. Then, the transfer material discharged out of the main assembly M as a final color print.

The residual toner on the photosensitive drum is removed by a cleaning device 7 comprising a known fur brush, blade or the like. The toner on the transfer drum 6a is also removed by a transfer drum cleaning device 6f such as a fur brush, web or the like, as desired, and in addition, residual charge is removed by a roller 6g.

In a color image forming apparatus described above, the electric power consumed by the charging roller 2a of the primary charging device 2 during the image forming operation is measured, and simultaneously, the toner fusing on the photosensitive drum 1 surface is observed.

Figure 5:
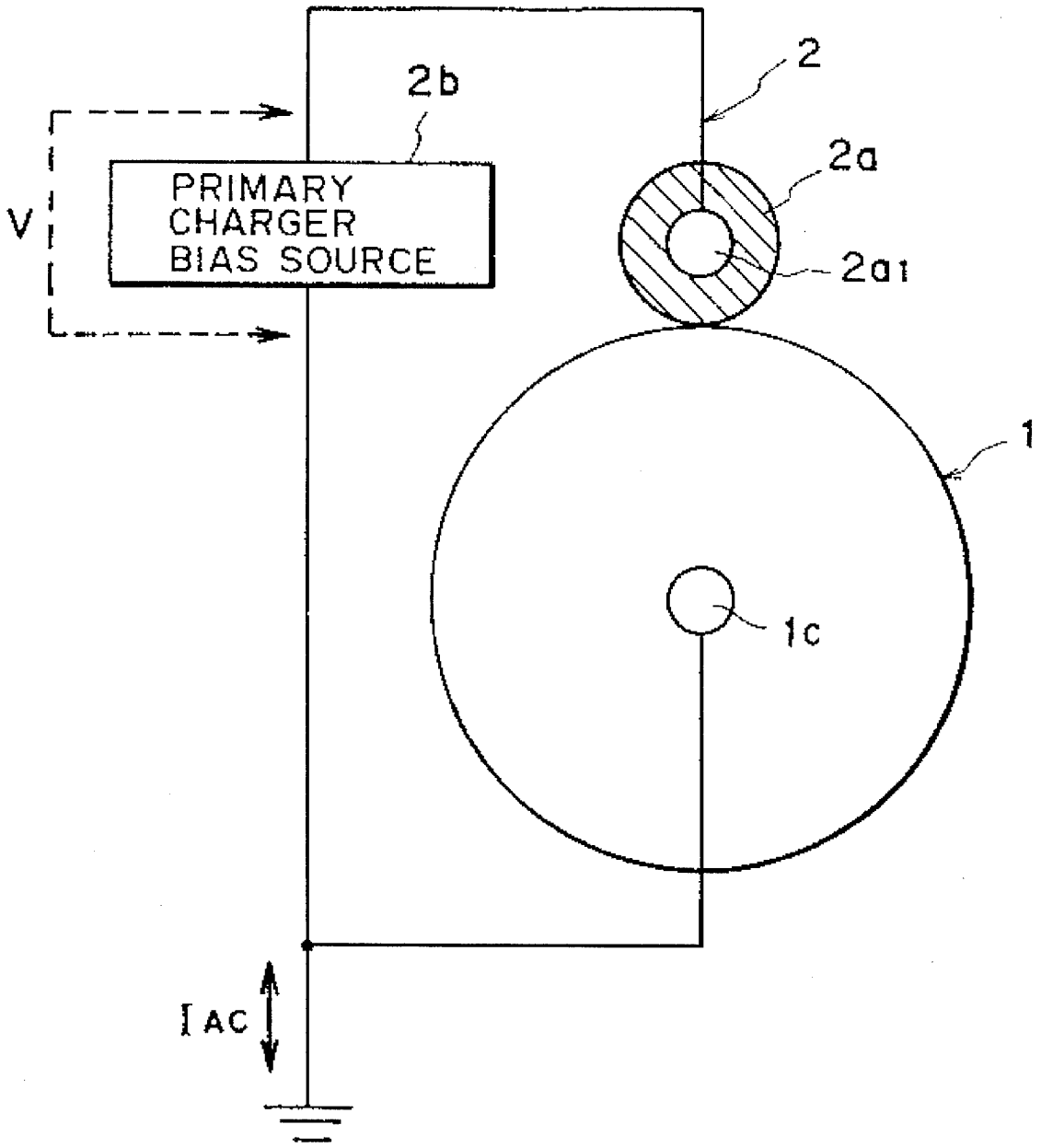
FIG. 5 is an enlarged view illustrating a primary charging process in Embodiment 1.

Referring to FIG. 5, the description will be made as to the measuring method of the power consumption by the charging roller 2a. In the apparatus shown in the Figure, the primary charging process of the image forming apparatus of FIG. 1 is illustrated in an enlarged view. The photosensitive drum 1 has a diameter of approx. 40 mm, and the charging roller 2a has a diameter of approx. 12 mm and an effective charging length L of approx. 250 mm. The charging roller is supplied with a voltage from a primary charger bias source 2b. The bias voltage V produced by the primary charger bias source 2b is a DC voltage of −700 V biased with a sine alternating voltage, and the oscillating voltage thus provided is applied to the metal core 2a1 of the charging roller 2a, by which the surface of the photosensitive drum 1 is uniformly charged. The metal core 1c of the photosensitive drum 1 is commonly grounded with the primary charger bias source 2b. The AC current $I_{AC}$ in the circuit and the bias primary charger bias V produced by the voltage source 2b, are observed by an oscilloscope to check the waveform thereof. There, there is a phase difference between the waveforms in the bias voltage V and the AC current $I_{AC}$ in the circuit, and the phase difference is expressed by θ. Then, the power consumption P of the charging roller 2a is expressed by:

$$P=(1/2^{1/2})\times Vpp\times I_{AC}\times\cos\theta \quad (1)$$

where Vpp is a peak-to-peak voltage of the bias voltage V.

The method at the consumed power measurement is not limited to above, but power meter or the like is usable.

Figure 6:
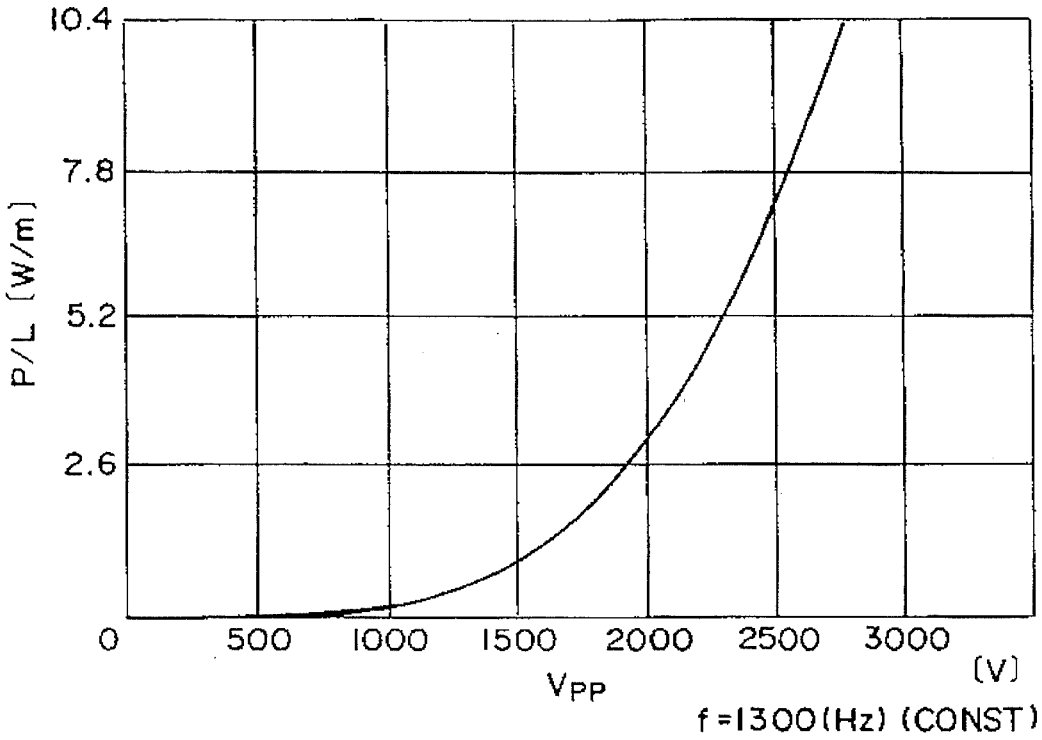
FIG. 6 is a graph of peak-to-peak Vpp of the charging device vs. electric power consumption P.
Figure 7:
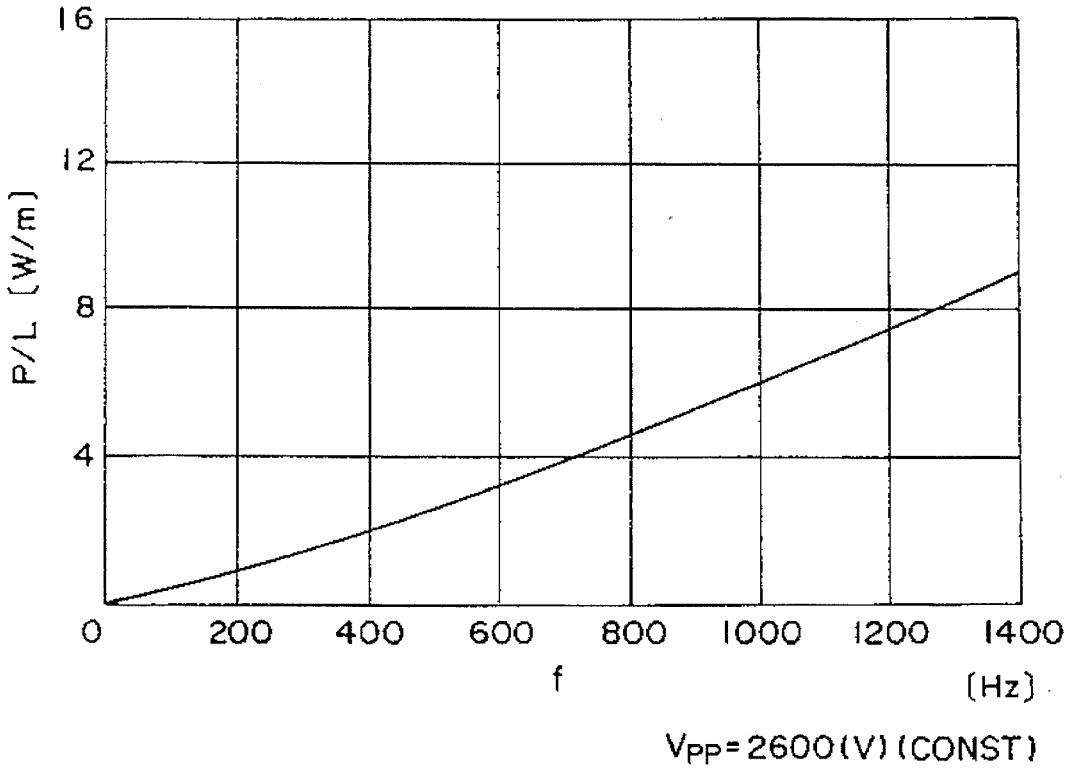
FIG. 7 is a graph of a frequency f of the charging device vs. electric power consumption in Embodiment 1.

The description will be made as to a relationship between a consumed power P of the charging roller 2a and the primary charging bias voltage. FIG. 6 is a graph showing a relationship between the consumed power P/roller length L and the primary bias voltage Vpp. As will be understood, P/L increases with increase of Vpp. FIG. 7 is a graph showing a relationship between the consumed power P/roller length L and a frequency f of the primary charging bias voltage. As will be understood, P/L increases with increase of the frequency f. In FIG. 6, f= constant (1300 Hz) and in FIG. 7 Vpp is constant (2600 V).

As described in the foregoing, the consumed power P of the charging roller 2a is dependent on the Vpp of the primary charging bias voltage and the frequency f of the primary charging bias voltage. Therefore, the toner fusing on the photosensitive drum 1 has been observed while one of Vpp and f is fixed, and the other is varied.

[Result 1 ]

The frequency f of the primary charging bias voltage is fixed at 1300 Hz, and Vpp of the primary charging bias voltage is changed, so that the power consumption of the charging roller 2a is changed. Full-color images are formed intermittently on 3000 transfer materials, and the toner fusing on the photosensitive drum 1 is observed. The image formation tests are carried out under a high temperature and high humidity condition (temperature of 30° C. and humidity of 80%). The results of the experiments are shown in Table 2. In this embodiment, the length of the urethane rubber layer 2a3 of the charging roller is equal to the length of the charging nip N between the charging roller 2a and the photosensitive drum 1, and therefore, it is the same as the effective charging length L. The process speed of the photosensitive drum is fixed at 0.1 m/sec.

TABLE 2

| | Heat generation per unit charging area (J/m²) | | | | | | | |
|---|---|---|---|---|---|---|---|---|
| | 2 | 10 | 20 | 30 | 50 | 60 | 100 | 700 |
| Toner fusing prevention | G | G | G | G | G | NG | NG | NG |

The toner fusing on the photosensitive drum has been observed through microscope, and in the Table, "G" means that the toner is not fused on the photosensitive drum. In addition, using the photosensitive drum exhibiting "G", halftone images are formed through PWM (multi-level), and the resultant images are observed, and it has been confirmed that there is no image non-uniformity due to the toner fusing. In the Table, "NG" means that the toner fusing occurs on the photosensitive drum.

The result of this experiment is that the toner fusing does not occur when the heat generation per unit area of the charging roller 2a (= the heat generation per unit area of the region where the charging roller is effective to charge the photosensitive member) P/(vxL) is 50 J/m² or lower. When the heat generation per unit area of the charging roller 2a is 50 J/m², Vpp is 2300 V.

[Result 2 ]

The process speed is fixed at 0.1 m/sec, and Vpp of the primary charging bias voltage is fixed at 2600 V, while the frequency f of the primary charging bias voltage is changed, thus changing the power consumption P of the charging roller 2a. Full-color images are intermittently formed on 3000 sheets, and then the toner fusing on the photosensitive drum 1 is observed. The image formation tests are carried out under the high temperature and high humidity condition (temperature of 30° C. and humidity of 80%). The results are shown in Table 3.

TABLE 3

| | Heat generation per unit charging area (J/m²) | | | | | | | |
|---|---|---|---|---|---|---|---|---|
| | 2 | 10 | 20 | 30 | 50 | 60 | 100 | 200 |
| Toner fusing prevention | G | G | G | G | G | NG | NG | NG |

"G" and "NG" mean as in Result 1. The result of this experiments is that the toner fusing does not occur when the heat generation per unit area of the charging roller P/(vxL) is 50 J/m² or lower. The frequency f is 850 Hz when the heat generation per unit area of the charging roller 2a P/(vxL) is 50 J/m$^2$ or lower.

[Result 3]

The peak-to-peak voltage Vpp of the primary charging voltage is fixed at 2600 V, and the frequency f is fixed at 1300 Hz, while the process speed v is changed so that the heat generation per unit area per unit time in the region where the charging roller 2a effects the charging action, P/(vxL) is changed. Full-color images are intermittently formed on 3000 transfer materials, and then the toner fusing on the photosensitive drum 1 is observed. The image formation tests are carried out under a high temperature and high humidity condition (30° C. and 80 %).

The results are shown in Table 4.

TABLE 4

| Process speed (m/S) | 0.30 | 0.20 | 0.15 | 0.12 | 0.10 | 0.05 |
|---|---|---|---|---|---|---|
| Heat generation per unit charging area (J//m$^2$) | 25 | 38 | 51 | 64 | 76 | 153 |
| Toner fusing prevention | G | G | G | NG | NG | NG |

"G" and "NG" mean the same as in Result 1. In this experiments, the toner fusing does not occur when the heat generation per unit area of the charging roller 2a P/(vxL) is 51 J/m$^2$ or lower. The process speed at this time is 0.15 m/sec.

Additional results is that the above-described Result 1, 2 and 3 were substantially the same as with low melting point toner having MI value of 0.5 g/10 min. or larger.

From the Results 1, 2 and 3, described above, it is understood that there is a close relation between the toner fusing on the photosensitive drum 1 and the power consumption of the charging roller 2. More particularly, even if a low melting point toner having MI value of 0.5 g/10 min. or larger is used, the toner fusing can be prevented by making the heat generation per unit area of the charging roller 2a P(vxL) not more than 50 J/m$^2$. In order to suppress the power consumption P, both of Vpp and frequency may be lowered, as has been described in conjunction with FIGS. 6 and 7, but it is more effective to lower Vpp, since it increases and decreases the power consumption P as a logarithmic function.

When the process speed is 0.1 m/sec, it is desirable that the bias voltage to the charging roller 2a has a frequency of 650 Hz at minimum and Vpp of 1400 V in order to stably charge the photosensitive drum 1 without cyclic charging non-uniformity, and therefore, P/(vxL) is preferably not less than 2 J/m$^2$.

From the foregoing, it will be understood that the toner fusing on the photosensitive drum 1 can be avoided by satisfying $2 \leqq P/(vxL) \leqq 50$ J/m$^2$, where P is the electric power consumed by the charging roller 2a, L is an effective charging length of a transfer nip N.

Embodiment 2

As described in Embodiment 1, the toner fusing on the photosensitive drum 1 can be prevented by lowering the power consumption of the charging roller 2a. In Embodiment 2, the waveform of the bias voltage applied to the charging roller 2a is changed from the sine wave of Embodiment 1, so that the power consumption P is lowered to prevent the toner fusing.

Figure 8:
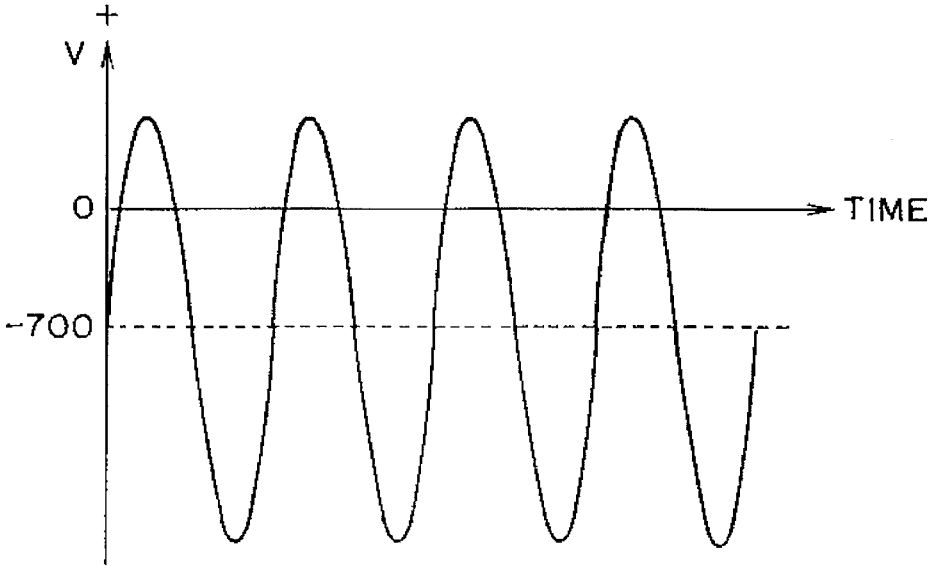
FIG. 8 is a graph of a waveform of a primary charging bias in Embodiment 1.

FIG. 8 shows a waveform of the primary charging bias voltage of this embodiment. The waveform of the voltage is provided by a DC voltage of −700 V biased with a sine wave alternating voltage having a frequency of 1300 Hz and Vpp of 2600 V. The primary charging property is depending on the frequency of the AC voltage and Vpp thereof. Therefore, if the frequency and Vpp are constant, the equivalent charging property can be provided by the use of a bias voltage having a different waveform.

Figure 9:
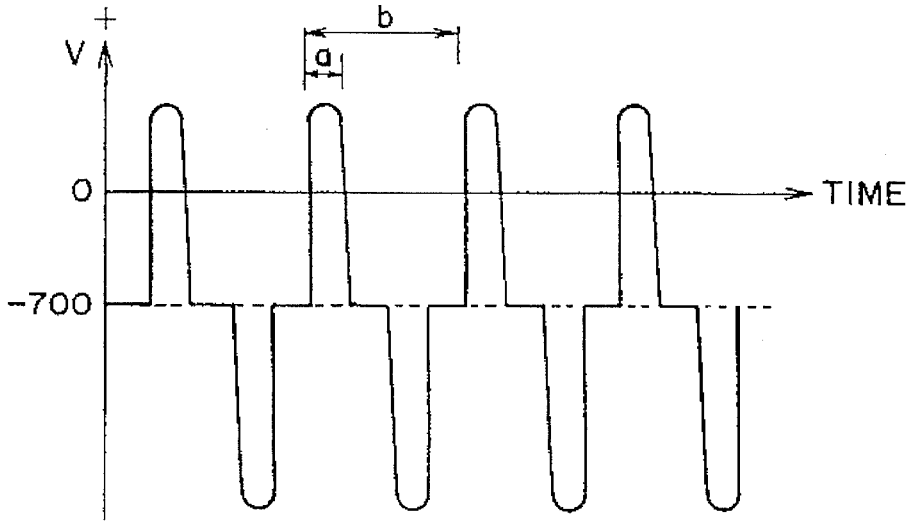
FIG. 9 shows a waveform of a primary charging bias voltage in Embodiment 2.

In this embodiment, the waveform is changed without changing the frequency and Vpp of the AC voltage. By this, the power consumption of the charging roller 2a is decreased, so that the fusing is decreased. FIG. 9 shows a waveform of a primary charging bias voltage used in this embodiment. The shown waveform is in the form of a DC voltage of −700 V biased with a rectangular waveform having blanks. The frequency is 1300 Hz and Vpp is 2600 V. In order to decrease the charging noise, the corners of the peak of the rectangular wave are rounded. The power consumption P of the charging roller 2a decreases with decrease of the time ratio a/b between one period of the waveform (b) and the width of the rectangular part (a).

By changing a/b, the full-color image forming operations are intermittently carried out for 3000 transfer sheets, and then, the toner fusing on the photosensitive drum 1 is observed. The image forming operations are carried out under a high temperature and high humidity condition of 30° C. and 80%. The results are shown in Table 5.

TABLE 5

| a/b | 0.1 | 0.15 | 0.2 | 0.25 | 0.3 | 0.35 | 0.4 | 0.5 |
|---|---|---|---|---|---|---|---|---|
| Toner fusing prevention | G | G | G | G | G | NG | NG | NG |

"G" and "NG" mean the same as with Embodiment 1. In this experiments, the toner fusing does not occur when a/b is 0.25 or lower. When a/b is 0.25, the heat generation per unit charging area of the charging roller 2a is 52 J/m$^2$.

In this embodiment, only bias waveform is changed, but better result is obtained by also lowering the frequency and Vpp.

As described in the foregoing, the toner fusing on the photosensitive drum is accomplished by lowering the power consumption P using a waveform different from a conventional sine waveform as the waveform of the bias voltage applied to the charging roller 2a.

Embodiment 3

In order to prevent the toner fusing onto the photosensitive drum 1, it is desired that the frequency of the bias voltage applied to the charging roller 2a is minimized, as will be understood from Embodiment 1. In the image forming apparatus of this embodiment, the minimum required frequency is 650 Hz to provide the stabilized charging, when the process speed is fixed at 0.1 m/sec, and by controlling the bias voltage to the above-described frequency, the toner fusing can be prevented most effectively.

However, the frequency of the primary charging bias voltage is controlled by an RC circuit in the primary charging bias voltage source, and therefore, the accuracy thereof is dependent on the elements in the circuit with the unavoidable result of approx. ±10% error. In view of this, the frequency is required to be set to 710 Hz taking −10% error into account, although the frequency is desired to be set to 650 Hz, ideally. Therefore, in this embodiment, a novel primary charging bias frequency control method, the accuracy of the frequency is enhanced to reduce the toner fusing.

Figure 10:
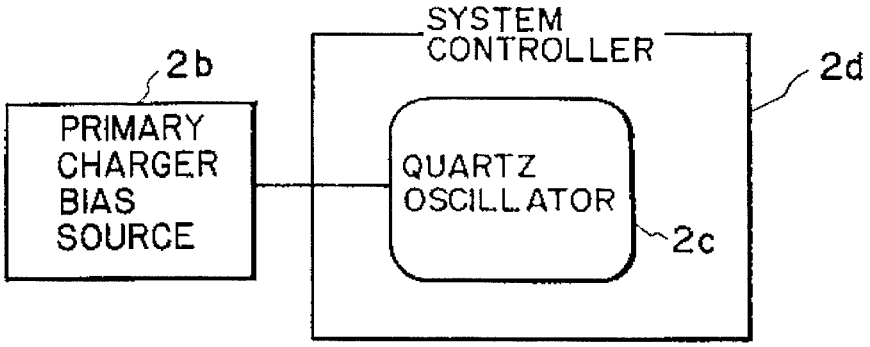
FIG. 10 shows a primary charging bias control circuit in Embodiment 3.

FIG. 10 shows a primary charging bias control circuit usable with this embodiment. Referring to the Figure, the method of primary frequency control will be described. The shown device comprises a system controller 2*d* (DC controller) and a primary charger bias source 2*b*. In the system controller 2*d*, there is a high accuracy quartz oscillator 2*c* for control of the writing start timing of the laser beam. On the basis of the pulse produced by the quartz oscillator 2*c*, the frequency of the primary charging bias voltage is extracted, and is supplied into the primary charger bias source 2*b*, by which the frequency error of the primary charging bias voltage can be reduced to ±0.1%. With this method, there is no need of adding an oscillator for the primary bias frequency control, and therefore, the cost increase can be minimized. By this control method, the frequency of the charging bias can be reduced to the minimum with the result that the power consumption P of the charging roller 2*a* can be reduced.

By the use of the primary charging bias frequency of this novel type, the frequency accuracy can be increased, and the toner fusing on the photosensitive drum can be reduced without cost increase.

In the foregoing description, the contact charging member has been in the form of a charging roller 2*a*, but another charging member such as blade, belt, brush or the like is usable.

The peak-to-peak voltage of the oscillating voltage applied to the charging member for the purpose of uniforming the potential of the member to be charged, is preferably not less than twice as large as the charge starting voltage of the member to be charged (image bearing member). The charge starting voltage is a DC voltage with which the charging of the image bearing member starts when the charging member is supplied only with a DC voltage which is gradually increased.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for bearing an image comprised of toner;

a charging member contactable to said image bearing member to charge said image bearing member, said charging member being adapted for receiving a voltage;

wherein the toner has a melt index of not less than 0.5 g/10 min.; and $$P/(v \times L) \leqq 50 \text{ J/m}^2$$

where v is a movement speed of said image bearing member when said image bearing member is charged by said charging member (m/sec), L is an effective charging length of said charging member, measured in a direction perpendicular to a movement direction of said image bearing member (m), and P is an amount of electric power consumed by said charging member (W).

2. An apparatus according to claim 1, wherein the following is further satisfied:

$$P/(v \times L) \geqq 2 \text{ J/m}^2.$$

3. An apparatus according to claim 1 or 2, wherein the voltage has an oscillating component.

4. An apparatus according to claim 1 or 2, wherein said charging member is a roller.

5. An apparatus according to claim 1 or 2, wherein the toner is a color toner.

6. An apparatus according to claim 1 or 2, further comprising a transfer material carrying member for carrying a transfer material, wherein toner images of different colors are superposedly transferred onto a transfer material carried on the material carrying member.

7. An apparatus according to claim 3, wherein the voltage includes a first voltage level constant for a predetermined period, and second and third voltage levels alternating relative to the first voltage level, within a period.

8. An apparatus according to claim 7, wherein the second voltage level occupies not more than 25% in one period of the voltage.

9. An apparatus according to claim 3, wherein the voltage has a peak-to-peak voltage which is not less than twice as large as a charge starting voltage for said image bearing member.

10. An apparatus according to claim 1 or 2, wherein said image bearing member is a photosensitive member.

* * * * *

UNITED STATES PATENT AND TRADEMARK OFFICE

CERTIFICATE OF CORRECTION

PATENT NO. : 5,543,900

DATED : August 6, 1996

INVENTOR(S) : Maebashi et al.

It is certified that error appears in the above-identified patent and that said Letters Patent is hereby corrected as shown below:

COLUMN 1:

Line 22, "As yellow," should read --Yellow,--;
Line 28, "800 dpi, for example," should read --800 dpi.--;
Line 50, "toner," should read --toner.--;
Line 51, "material" should read --material is--;
Line 55, "A" should read --a--; and
Line 60, "lower," should read --lower),--.

COLUMN 4

Line 16, "value" should read --values--

COLUMN 5:

Line 11, "material" should read --material is--.

UNITED STATES PATENT AND TRADEMARK OFFICE

CERTIFICATE OF CORRECTION

PATENT NO. : 5,543,900

DATED : August 6, 1996

INVENTOR(S) : Maebashi et al.

It is certified that error appears in the above-identified patent and that said Letters Patent is hereby corrected as shown below:

COLUMN 10:

Line 29, "the" should read --the transfer--.

Signed and Sealed this

Twenty-first Day of January, 1997

Bruce Lehman

*Attest:*

BRUCE LEHMAN

*Attesting Officer*

*Commissioner of Patents and Trademarks*